US007775826B1

(12) United States Patent
Wang

(10) Patent No.: US 7,775,826 B1
(45) Date of Patent: Aug. 17, 2010

(54) CARD CONNECTOR

(75) Inventor: Yao-Ting Wang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/457,503

(22) Filed: Jun. 12, 2009

(51) Int. Cl.
*H01R 3/00* (2006.01)

(52) U.S. Cl. ..... 439/489; 439/630

(58) Field of Classification Search ..... 439/489, 439/630

See application file for complete search history.

(56) References Cited

U.S. PATENT DOCUMENTS 6,039,599 A * 3/2000 Benjamin et al. ..... 439/489
6,135,809 A * 10/2000 Asakawa ..... 439/489
6,352,445 B2 * 3/2002 Takei et al. ..... 439/489
6,431,893 B1 * 8/2002 Chang et al. ..... 439/188
6,478,595 B2 * 11/2002 Nishioka ..... 439/188
7,137,836 B2 * 11/2006 Lu et al. ..... 439/188
7,527,528 B2 * 5/2009 Yu et al. ..... 439/630
7,682,197 B2 * 3/2010 Wang ..... 439/630

* cited by examiner

*Primary Examiner*—Gary F. Paumen
(74) *Attorney, Agent, or Firm*—Rosenberg, Klein & Lee

(57) ABSTRACT

A card connector includes an insulating housing defining a receiving room for receiving an electronic card, a cover coupled on the insulating housing, and a monitoring member having a base plate disposed in the insulating housing, a monitoring means extending along the insertion direction of the card, and a connecting arm perpendicularly connecting the monitoring means to the base plate. The connecting arm is inclined upward into the receiving room to make the monitoring means locate in the receiving room. One end of the monitoring means is higher than the other end thereof for electrically abutting against the cover, wherein the lower end of the monitoring means is adapted for being pressed downward by the card to make the connecting arm move downward and further make the upper end thereof disconnect from the cover so as to monitor whether the card is fully inserted in the card connector or not.

8 Claims, 3 Drawing Sheets

CARD CONNECTOR

BACKGROUND OF THE INVENTION

1. Field of the Invention

The present invention relates to a card connector, and more particularly to a card connector capable of monitoring whether an electronic card is fully inserted therein or not.

2. The Related Art

With the development of electronic technology, various electronic cards are widely used in electronic products, such as digital cameras, personal digital assistants (PDA) and mobile phones etc. The conventional electronic product defines a card connector so as to receive an electronic card therein. The card connector includes an insulating housing, a plurality of electrical terminals and a monitoring assembly disposed in the insulating housing respectively. The monitoring assembly includes a rigid first monitoring member and a flexible second monitoring member adapted for being pressed by the card to electrically contact the first monitoring member so as to monitor whether the card is fully inserted in the card connector or not. However, the achievement of the monitoring function of the card connector must depend on the cooperation between the first and second monitoring members. As a result, two kinds of molds are needed to shape the monitoring members respectively when manufacturing the card connector so that takes a relatively high manufacture cost.

SUMMARY OF THE INVENTION

An object of the present invention is to provide a card connector adapted for receiving an electronic card therein and including an insulating housing, a plurality of electrical terminals disposed in the insulating housing and electrically contacting the card, a cover coupled on the insulating housing, and a monitoring member disposed in the insulating housing behind the electrical terminals. The insulating housing has a base board and two sidewalls extending upward from two opposite side edges of the base board. A receiving room is defined by the base board and the sidewalls for receiving the card therein. The cover has a top board covered on the receiving room. The monitoring member has a flat base plate disposed in a rear of the base board, a monitoring means extending along the insertion direction of the card, and a connecting arm perpendicularly connecting the monitoring means to the base plate. The connecting arm is inclined upward into the receiving room to make the monitoring means locate in the receiving room. A rear end of the monitoring means far away from the electrical terminals is higher than a front end thereof adjacent to the electrical terminals for electrically abutting against a bottom surface of the top board of the cover, wherein the front end of the monitoring means is adapted for being pressed downward by the card to make the connecting arm move downward and further make the rear end thereof disconnect from the top board of the cover so as to monitor whether the card is fully inserted in the card connector or not. Therefore, only one mold is needed to shape the monitoring member when manufacturing the card connector of the present invention so that takes a relatively low manufacture cost.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
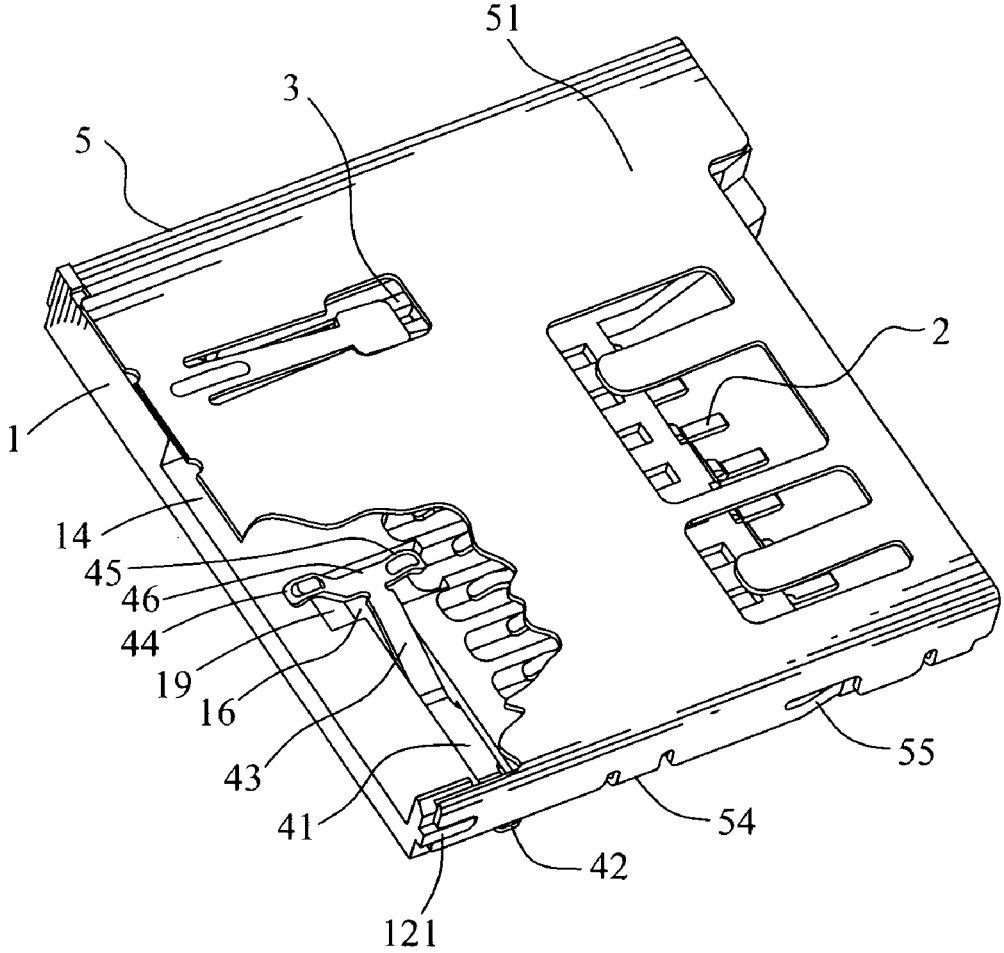
FIG. 1 is a perspective view of a card connector in accordance with the present invention, wherein a cover is partially cut away.
Figure 3:
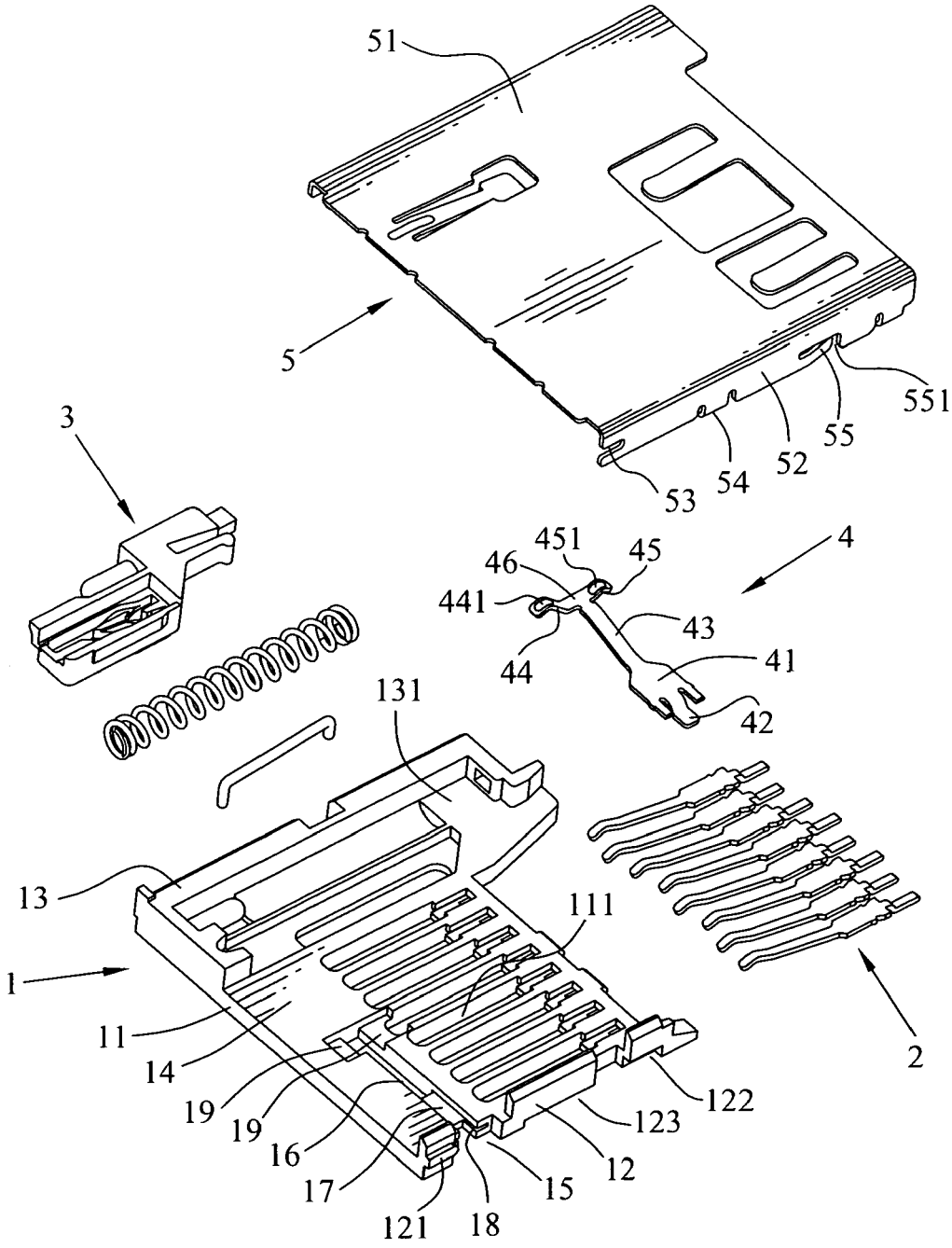
FIG. 3 is an exploded view of the card connector of FIG. 1.

Referring to FIG. 1 and FIG. 3, a card connector in accordance with the present invention includes an insulating housing 1, a plurality of electrical terminals 2, an ejecting device 3, a monitoring member 4 and a cover 5.

Referring to FIG. 3 again, the insulating housing 1 has a rectangular flat base board 11. Two opposite side edges of the base board 11 extend upward to respectively form a restricting sidewall 12 and an accommodating sidewall 13 each extending longitudinally. A receiving room 14 is formed among the base board 11 and the sidewalls 12, 13 for receiving a card 6 shown in FIG. 4 therein. The accommodating sidewall 13 defines an accommodating recess 131 extending longitudinally to face the restricting sidewall 12 and communicating with the receiving room 14 for receiving the ejecting device 3 therein. A front of the base board 11 defines a plurality of terminal passageways 111 arranged at regular intervals along a transverse direction thereof and each extending longitudinally to communicate with the receiving room 14. An outside of each of the sidewalls 12, 13 protrudes outward to form a locking rib 121 at a rear end thereof, and is further provided with a fastening groove 122 and a receiving groove 123 at a bottom thereof, wherein the receiving groove 123 is located between the locking rib 121 and the fastening groove 122.

The restricting sidewall 12 is further severed by a notch 15 between the locking rib 121 and the receiving groove 123. A rear of the base board 11 defines a receiving cavity 16 extending transversely behind the terminal passageways 111 and vertically passing therethrough to communicate with the receiving room 14. A top of one end of the receiving cavity 16 further extends transversely to form a holding fillister 17 connected with the notch 15. Two opposite sides of a bottom of the holding fillister 17 oppositely extend sideward into the base board 11 to form a pair of fixing slots 18. A top of the other end of the receiving cavity 16 far away from the notch 15 oppositely extend sideward to form a pair of receiving fillisters 19 aligned longitudinally with each other and communicating with the receiving room 14.

In FIG. 3, the monitoring member 4 has a rectangular flat base plate 41. A middle of one side edge of the base plate 41 is bent downward and then extends sideward to form a soldering tail 42 opposite to the base plate 41. A middle of the other side edge of the base plate 41 extends toward an opposite direction to the soldering tail 42 and is inclined upward to form a connecting arm 43. A monitoring means 46 is perpendicularly connected to a free end of the connecting arm 43 and extends longitudinally to have two opposite ends levelly higher than two opposite side edges of the connecting arm 43. A front end of the monitoring means 46 is arched upward to form a pressing arm 45, and a propping apex 451 is protruded upward across an arched portion of the pressing arm 45. A rear end of the monitoring means 46 is inclined upward and then bent downward to form a monitoring arm 44 higher than the pressing arm 45. A contact apex 441 is protruded upward across a bent portion of the monitoring arm 44.

In FIG. 3 again, the cover 5 has a rectangular flat top board 51. Two opposite side edges of the top board 51 extend downward to form two side boards 52. Each of the side boards 52 defines a locking slit 53 at a rear end thereof, and an opening 551 at a front thereof. A rear edge of the opening 551 extends forward and is inclined inward to form an elastic strip 55. A bottom edge of each of the side boards 52 is bent inward to form a soldering foot 54 between the locking slit 53 and the elastic strip 55.

Figure 2:
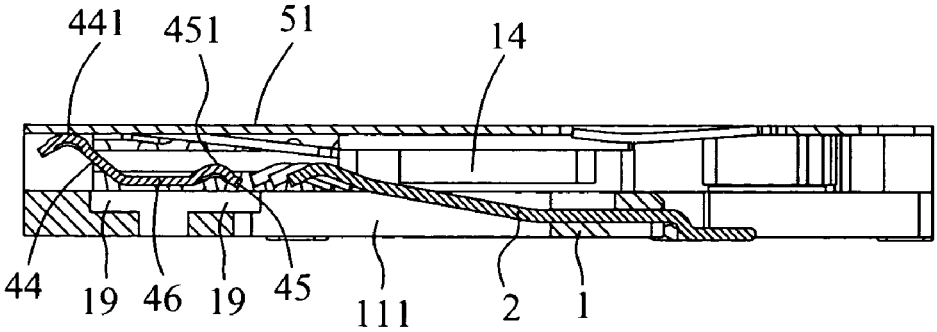
FIG. 2 is a cross-sectional view of the card connector of FIG. 1.

Referring to FIG. 1 and FIG. 2, in assembly, the electrical terminals 2 are received in the corresponding terminal passageways 111 of the insulating housing 1. The ejecting device 3 is mounted in the accommodating recess 131 for withdrawing the card 6 from the card connector. The base plate 41 of the monitoring member 4 is held in the holding fillister 17 of the insulating hosing 1 and two opposite sides thereof are inserted in the respective fixing slots 18. The soldering tail 42 stretches into the notch 15 for being soldered to a printed circuit board (not shown). The connecting arm 43 is partially received in the receiving cavity 16 and partially stretches into the receiving room 14 to make the monitoring arm 44 and the pressing arm 45 locate in the receiving room 14 and respectively hanged above the corresponding receiving fillisters 19. The cover 5 is coupled on the insulating housing 1. The locking ribs 121 are snapped in the respective locking slits 53 and the elastic strips 55 are buckled in the respective fastening grooves 122. The soldering foot 54 is held in the receiving groove 123 for being soldered to the printed circuit board. The contact apex 441 of the monitoring arm 44 of the monitoring member 4 elastically abuts against a bottom surface of the top board 51 of the cover 5 for forming an electrical connection between the monitoring member 4 and the cover 5.

Figure 4:
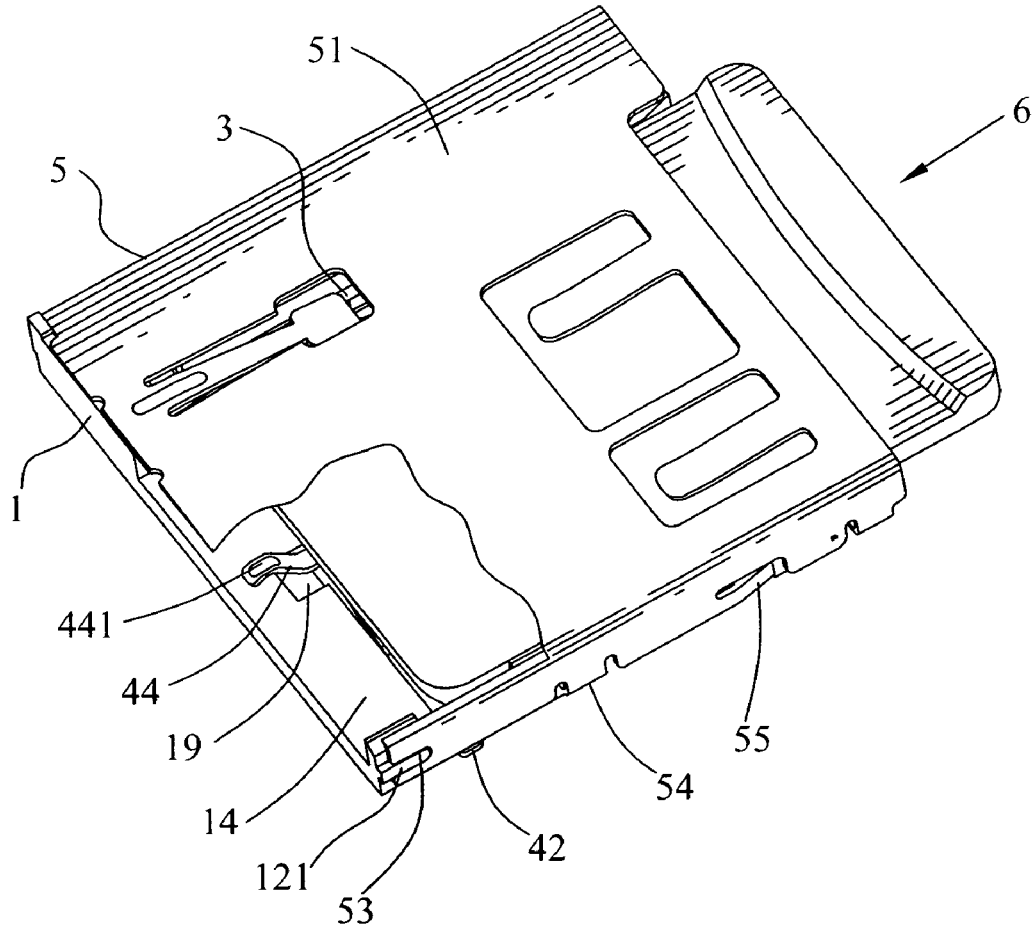
FIG. 4 is a perspective view of the card connector with the cutaway cover of FIG. 1, in which an electronic card is inserted.
Figure 5:
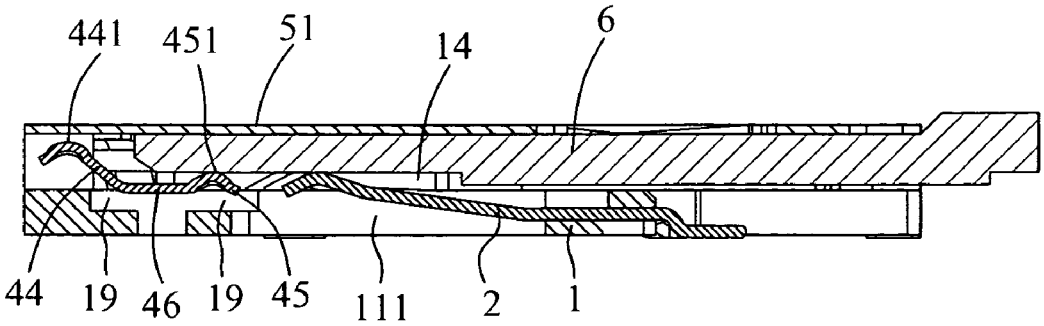
FIG. 5 is a cross-sectional view of the card connector with the card of FIG. 4.

Referring to FIG. 4 and FIG. 5, in use, the card 6 is inserted into the receiving room 14 of the card connector to electrically contact the electrical terminals 2. Moreover, the card 6 presses the propping apex 451 to make the pressing arm 45 and the connecting arm 43 pressed downward respectively into the corresponding receiving fillister 19 and the receiving cavity 16 that further drives the monitoring arm 44 to move downward partially into the corresponding receiving fillister 19. As a result, the contact apex 441 of the monitoring arm 44 is disconnected from the top bard 51 of the cover 5 with the monitoring arm 44 moving downward such that disconnects the electrical connection between the monitoring member 4 and the cover 5. At this moment, the card 6 is fully inserted in the card connector.

As described above, the pressing arm 45 of the monitoring member 4 can be pressed by the card 6 to make the connecting arm 43 move downward so as to drive the monitoring arm 44 to move downward and further make the contact apex 441 of the monitoring arm 44 disconnected from the top board 51 of the cover 5 to monitor whether the card 6 is fully inserted in the card connector or not. Therefore, only one mold is needed to shape the monitoring member 4 when manufacturing the card connector of the present invention so that takes a relatively low manufacture cost.

What is claimed is:

1. A card connector adapted for receiving an electronic card therein, comprising:

an insulating housing having a base board and two sidewalls extending upward from two opposite side edges of the base board, a receiving room being defined by the base board and the sidewalls for receiving the card therein;

a plurality of electrical terminals disposed in the base board of the insulating housing and electrically contacting the card;

a cover coupled on the insulating housing and having a top board covering the receiving room; and a monitoring member disposed in the insulating housing behind the electrical terminals, the monitoring member having a flat base plate disposed in a rear of the base board, a monitoring means extending along the insertion direction of the card, and a connecting arm perpendicularly connecting the monitoring means to the base plate, the connecting arm being inclined upward into the receiving room to make the monitoring means locate in the receiving room, a rear end of the monitoring means away from the electrical terminals being higher than a front end thereof adjacent to the electrical terminals for electrically abutting against a bottom surface of the top board of the cover, wherein the front end of the monitoring means is adapted for being pressed downward by the card to make the connecting arm move downward and further make the rear end thereof disconnect from the top board of the cover.

2. The card connector as claimed in claim 1, wherein the front end of the monitoring means is acted as a pressing arm and the rear end thereof is acted as a monitoring arm, the pressing arm is arched upward, and the monitoring arm is inclined upward to be higher than the pressing arm and has a free end further bent downward.

3. The card connector as claimed in claim 2, wherein a propping apex is protruded upward across an arched portion of the pressing arm for propping against the card, and a contact apex is protruded upward across a bent portion of the monitoring arm for electrically contacting the top board of the cover.

4. The card connector as claimed in claim 1, wherein one side edge of the base plate is bent downward and then extends toward an opposite direction to the connecting arm to form a soldering tail, one of the sidewalls is severed by a notch at a rear thereof, the soldering tail stretches into the notch.

5. The card connector as claimed in claim 4, wherein the rear of the base board defines a receiving cavity extending transversely and communicating with the receiving room for receiving the connecting arm of the monitoring member therein, a top of one end of the receiving cavity further extends transversely to form a holding fillister connected with the notch for holding the base plate therein, a top of the other end of the receiving cavity extends oppositely to form a pair of receiving fillisters aligned longitudinally with each other and communicating with the receiving room for receiving the two ends of the monitoring means therein respectively.

6. The card connector as claimed in claim 5, wherein two opposite sides of a bottom of the holding fillister oppositely extend sideward into the base board to form a pair of fixing slots for snapping two opposite sides of the base plate of the monitoring member therein.

7. The card connector as claimed in claim 1, wherein two opposite side edges of the top board of the cover extend downward to form two side boards, a bottom edge of each of the side boards is bent inward to form a soldering foot located under the respective sidewall.

8. The card connector as claimed in claim 1, wherein an outside of each of the sidewalls protrudes outward to form a locking rib at a rear end thereof and defines a fastening groove at a bottom thereof, two opposite side edges of the top board of the cover extend downward to form two side boards, each of the side boards defines a locking slit at a rear end thereof for snapping the corresponding locking rib therein, and an elastic strip extended forward and inclined inward to be buckled in the corresponding fastening groove.

* * * * *